United States Patent [19]

Grunder

[11] Patent Number: 4,577,852

[45] Date of Patent: Mar. 25, 1986

[54] APPARATUS FOR COUNTING THE SHEETS IN A STREAM OF PARTLY OVERLAPPING SHEETS

[75] Inventor: Roland Grunder, Vordemwald, Switzerland

[73] Assignee: Grapha-Holding AG, Hergiswil, Switzerland

[21] Appl. No.: 648,899

[22] Filed: Sep. 10, 1984

Related U.S. Application Data

[62] Division of Ser. No. 402,891, Jul. 29, 1982, abandoned.

[30] Foreign Application Priority Data

Aug. 11, 1981 [CH] Switzerland ..... 5151/81

[51] Int. Cl.[4] ..... B65H 29/34

[52] U.S. Cl. ..... 271/188; 271/189; 271/213

[58] Field of Search ..... 271/209, 213, 215, 217, 271/218, 188, 189; 198/503; 250/571; 493/28

[56] References Cited

U.S. PATENT DOCUMENTS

| | | | |
|---|---|---|---|
| Re. 23,641 | 4/1953 | Andren | 271/217 X |
| 3,507,492 | 4/1970 | Spencer | 271/218 X |
| 3,529,168 | 9/1970 | Guggisberg | 198/503 X |
| 3,548,995 | 12/1970 | Oderman | 271/218 X |
| 3,737,666 | 6/1973 | Dutro | 198/503 X |
| 3,834,289 | 9/1974 | Behrens | 271/265 X |
| 4,139,191 | 2/1979 | Muller | 271/218 X |

*Primary Examiner*—Richard A. Schacher
*Attorney, Agent, or Firm*—Peter K. Kontler

[57] ABSTRACT

An apparatus for counting the sheets of a stream of partly overlapping sheets wherein the leaders of the next-following sheets normally rest on the trailing ends of the preceding sheets has a transporting unit which defines a path having two mutually inclined portions with the second portion sloping downwardly at an angle of 15 to 90 degrees relative to the first portion so that the leaders of successive sheets are lifted off the trailing ends of the respective preceding sheets. A photocell generates signals on detection of successive leaders while the leaders are on their way from the first into the second portion of the path, i.e., while the leaders are separated from the trailing ends of the preceding sheets, and such signals are transmitted to a counter which regulates the conversion of sheets into a series of stacks containing preselected numbers of superimposed sheets. The photocell is installed substantially midway between the longitudinal marginal portions of the stream. The sheets which travel past the photocell are subjected to the deforming action of an endless belt or chain which causes the upper sides of the sheets to assume a concave shape with the deepmost portion of each sheet extending in parallelism with the direction of transport of the stream.

4 Claims, 4 Drawing Figures

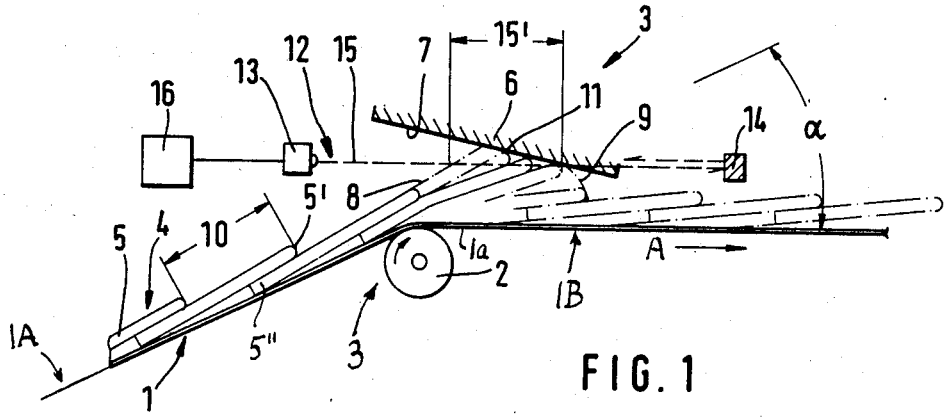
FIG. 1
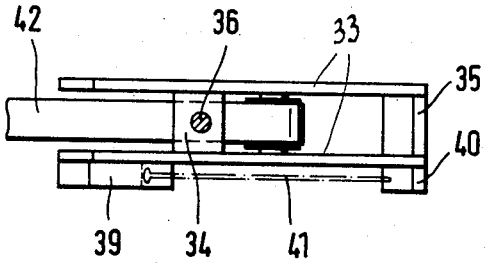
FIG. 3
FIG. 4
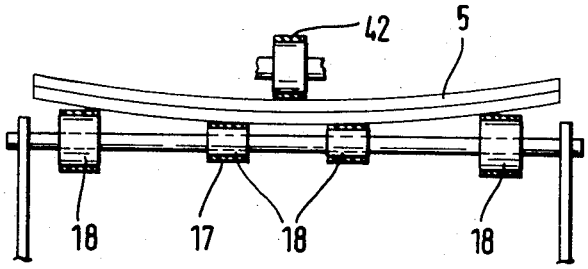

APPARATUS FOR COUNTING THE SHEETS IN A STREAM OF PARTLY OVERLAPPING SHEETS

This application is a division of application Ser. No. 402,891, filed July 29, 1982, now abandoned.

BACKGROUND OF THE INVENTION

The present invention relates to apparatus for manipulating sheets which consist of paper or the like, and more particularly to improvements in apparatus for manipulating sheets which are transported in the form of a so-called scalloped stream wherein the leader of each next-following sheet overlies the trailing end or portion of the respective preceding sheet. Still more particularly, the invention relates to improvements in apparatus for counting successive sheets of a stream of partially overlapping sheets, especially for the purpose of accumulating the sheets into stacks containing predetermined numbers of overlapping sheets.

It is already known to utilize a monitoring device which is placed next to the path of sheets in a stream of partially overlapping sheets and is designed to generate signals in response to advancement of the leaders of successive sheets therealong. As a rule, the monitoring device is placed close to the center of the path of the stream, i.e., midway between the lateral marginal portions of the sheets which constitute the stream. In many instances, the monitoring device comprises a sensor which is mounted on a carriage. The latter is pivotable or otherwise movable while tracking the leaders of successive sheets in the stream. The sensor is operatively connected with a counter which transmits signals in response to advancement of predetermined numbers of sheets past the sensor; such signals can be used to indicate the detection of a preselected number of sheets and/or to regulate the operation of devices downstream of the monitoring station.

A drawback of the just described conventional apparatus is that the sensor is likely to skip certain sheets, especially when the speed at which the sheets are transported past the monitoring station is increased above a threshold value which, at the present time, is in the range of approximately 14,000 sheets per hour. In other words, if the counter generates signals which are transmitted to a sheet stacking or gathering device, successive stacks of superimposed sheets are likely to contain different numbers of sheets if the speed of advancement of sheets exceeds the threshold value.

OBJECTS AND SUMMARY OF THE INVENTION

An object of the invention is to provide a novel and improved apparatus which can reliably count the number of sheets in a stream of partially overlapping sheets while the stream is transported at a speed which is a multiple of the maximum acceptable or permissible speed in heretofore known counting apparatus.

Another object of the invention is to provide a novel and improved apparatus which can manipulate successive sheets of a stream of partially overlapping sheets in such a way that each and every sheet can be detected and recorded even if the sheets are transported at a speed greatly exceeding 14,000 sheets per hour and even if the speed is in the range of up to and in excess of 70,000 per hour.

An additional object of the invention is to provide the apparatus with novel and improved means for locating the leaders of successive sheets in a scalloped stream of signatures or the like in optimum positions for detection of photoelectric or otherwise constructed detecting instrumentalities.

A further object of the invention is to provide a novel stacking apparatus which is associated with and receives signals from an apparatus of the above outlined character to accumulate a series of stacks containing predetermined numbers of sheets.

Another object of the invention is to provide the apparatus with novel and improved means for effecting partial singularization of sheets in a stream of partly overlapping sheets in order to more reliably detect the leaders of successive sheets in the course of or preparatory to a counting operation.

Another object of the invention is to provide a novel and improved method of counting successive sheets in a stream of rapidly advancing partially overlapping sheets and of thereupon stacking the sheets to ensure the presence of identical numbers of sheets in each of a long series of successively accumulated stacks.

A feature of the invention resides in the provision of an apparatus for manipulating sheets in a continuous or substantially continuous stream of partially overlapping sheets (e.g., signatures, folded paper sheets or the like) each of which has a leader and a trailing end with the leader of each next-following sheet overlying the trailing end of the respective preceding sheet. The apparatus comprises means for transporting the stream in a predetermined direction along a predetermined path having a first portion and a second portion located downstream of the first portion, as considered in the aforementioned direction, and sloping downwardly relative to the first portion at an angle of between 15 and 90 degrees so as to cause the leaders of successive sheets to move away from the trailing ends of the respective preceding sheets during advancement of successive sheets from the first into the second portion of the path, and means for monitoring the leaders of successive sheets while the leaders are separated from the trailing ends of the respective preceding sheets during transport of sheets from the first into the second portion of the path. The monitoring means can comprise means for generating signals on detection of successive leaders, and the apparatus preferably further comprises means for counting the signals, e.g., in order to control the operation of a sheet stacking device which forms stacks containing predetermined numbers of sheets. The monitoring means is preferably disposed at a level above and at least close to the central zone or region of the path, as considered transversely of the aforementioned direction, i.e., the monitoring means is preferably located, at least in part, midway between the marginal portions of the stream of sheets in the predetermined path.

The transporting unit comprises conveyor means including first and second sections which respectively define the first and second portions of the path. The transporting unit preferably further defines an orientation changing station which is disposed intermediate the two sections of the conveyor means and wherein (or on the way to which) the leaders of successive sheets begin to move away from the trailing ends of the respective preceding sheets. The conveyor means can comprise one or more endless belts each having an upper reach a first part of which constitutes the first section and the second part of which constitutes the second section. The orientation changing station can be defined by a pulley or the like which is disposed between the two portions of the upper reach or reaches. Alternatively, the transporting unit can comprise one or more belt, band or chain conveyors which define the first portion of the path and a preferably upright duct which defines the second portion of the path. The orientation changing station can be defined by a pulley or sprocket wheel at the discharge end of the belt, band or chain conveyor.

The apparatus preferably further comprises guide means defining between the first and second portions of the first mentioned path a second path along which the leaders of successive sheets advance during transport from the first into the second portion of the first mentioned path. Such guide means can be configurated and mounted in such a way that it imparts to the leaders of successive sheets a component of movement toward the sheets in the second portion of the first mentioned path. The guide means is preferably disposed above the central region of the first portion of the first mentioned path, and such central region is disposed at least substantially midway between the marginal portions of the stream and extends in parallelism the direction of transport of sheets along the first mentioned path. Such guide means can have at least one surface along which the leaders of successive sheets slide during advancement from the first into the second portion of the first mentioned path.

The monitoring means can comprise at least one photocell; however, other types of monitoring means (such as mechanical sensors, proximity detectors, devices operating with electromagnetic waves, and/or others) can be used with equal or similar advantage. If the monitoring means includes a photocell, the light source of the photocell is preferably mounted in such a way that it emits a light beam which impinges upon the leaders of successive sheets while the leaders advance from the first into the second portion of the first mentioned path and are thus separated from the trailing ends of the respective preceding sheets.

The apparatus can further comprise deforming means for imparting to the upper sides of sheets in the first portion of the first mentioned path a concave or substantially concave shape to thus stiffen the sheets which advance toward and whose leaders engage the guide means. The deforming means can constitute an endless flexible element mounted at a level above the central portion of the conveyor which defines the first portion of the first mentioned path, i.e., midway between those (marginal) portions of the just mentioned conveyor which extend in parallelism with the direction of transport of the sheets. The flexible element can comprise an endless chain, belt or band whose lower reach contacts the central or median portions of successive sheets and urges such portions of the sheets into contact or toward the aforementioned central portion of the conveyor defining the first portion of the first mentioned path, and this central portion is disposed at a level below the marginal portions of such conveyor.

The width of the aforementioned guide means above the first mentioned path is preferably a small fraction of the width of the first mentioned path, preferably not more than half the width of the first mentioned path.

Another feature of the invention resides in the provision of a sheet manipulating apparatus which comprises a duct (such as the aforementioned duct which is preferably upright and defines the second portion of the predetermined path for the stream of partially overlapping sheets), means (such as the conveyor which defines the first portion of the aforementioned path) for feeding into the duct successive sheets of the stream so that successive sheets of the stream enter the duct (e.g., through the open upper end of the duct), and means for stacking the sheets which enter into and descend in the duct. The stacking means comprises at least one mobile sheet intercepting member which is movable into and from the interior of the duct, and means for moving the intercepting member between a first position in which the intercepting member extends into the duct so as to occupy at least two-thirds of the respective cross-section of the duct and a second position in which the intercepting member is sufficiently retracted to allow the sheets in the duct to descend therealong. The intercepting member preferably includes a rake-like portion with several prongs which extend into the duct in the first position of the intercepting member. The stacking means can comprise at least one additional intercepting member at a level below the first named intercepting member and means for moving the additional intercepting member into and from the duct. Such additional intercepting member can form part of or it may constitute a gate which is retractible from the duct so that a stack of sheets which has accumulated thereon can descend onto a stack removing and/or reorienting device. The additional intercepting member preferably also comprises a pronged rake-like portion whose prongs are movable into and from the interior of the duct.

The feeding means can cause successive sheets of the stream to slope downwardly at the discharge end of the feeding means so that the leaders of successive sheets which, as stated above, normally overlap the trailing ends of the respective preceding sheets, are separated from the neighboring trailing ends. Such apparatus can further comprise the aforementioned counting means which can be said to comprise the aforementioned monitoring means, i.e., a means for detecting and generating signals in response to detection of leaders of successive sheets while the leaders are separated from the trailing ends of the respective preceding sheets.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a schematic partly elevational and partly longitudinal vertical sectional view of an apparatus which embodies one form of the invention;

FIG. 3 is a fragmentary plan view of a detail as seen in the direction of arrow III in FIG. 2; and FIG. 4 is a fragmentary end elevational view substantially as seen in the direction of arrow IV in FIG. 2.

DESCRIPTION OF THE PREFERRED EMBODIMENTS

Figure 2:
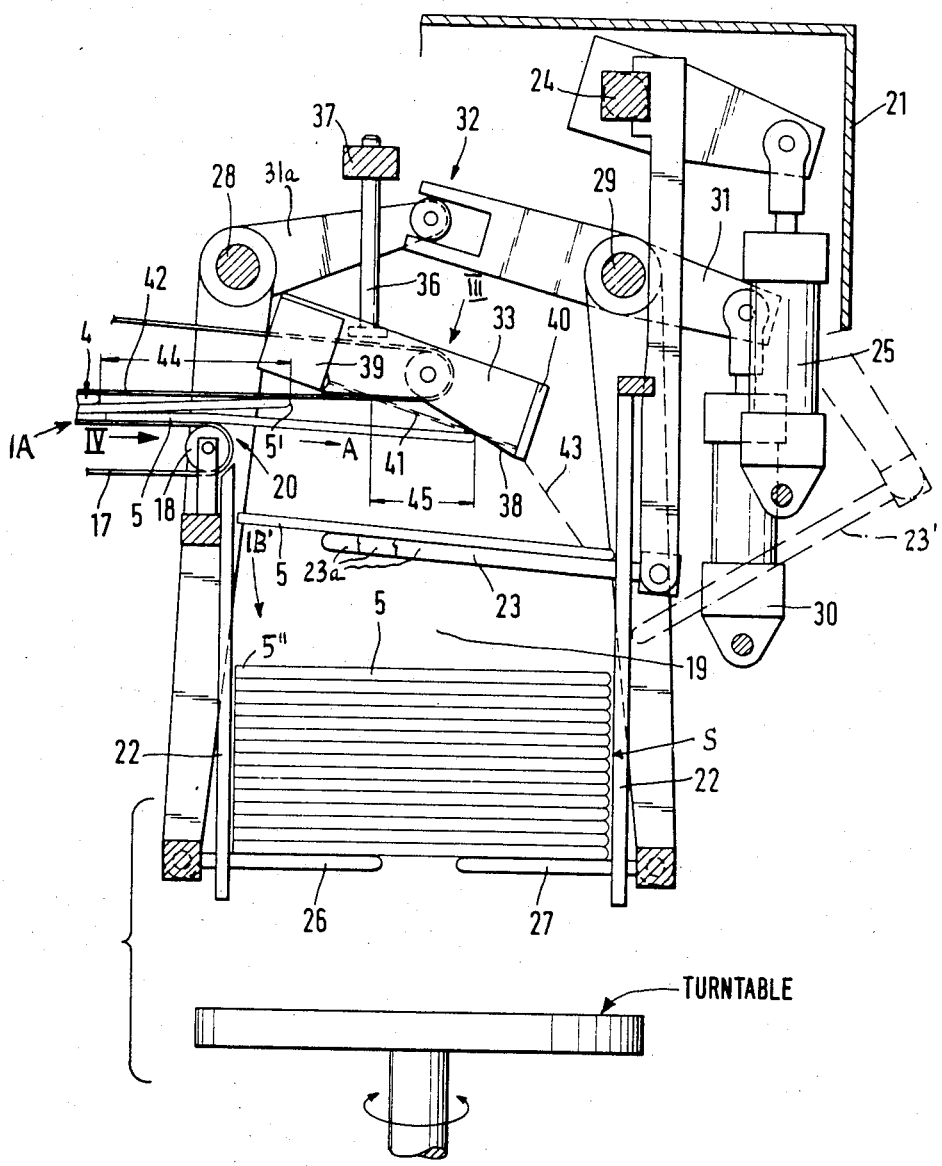
FIG. 2 is a fragmentary vertical sectional view of a modified apparatus which is combined with means for accumulating groups of sheets into stacks.

Referring first to FIG. 1, there is shown an apparatus which comprises a transporting unit 1 for a continuous stream 4 of partially overlapping sheets 5. Each sheet 5 can constitute a signature, a folded-over piece of paper or a set of overlapping sheets which are folded over and are about to be accumulated into stacks or other types of formations. As can be seen in FIG. 1, the leaders 5′ of successive sheets 5 overlie the trailing ends or portions 5″ of the respective preceding sheets 5. The character 10 denotes the distance between the leaders 5′ of successive sheets 5. The manner in which the stream 4 of partially overlapping sheets is formed in a bookbinding, newspaper gathering or other machine forms no part of the present invention.

The transporting unit 1 can comprise one or more conveyors, e.g., one or more endless belt or band conveyors which are trained over suitable pulleys (not shown) and are driven so that their upper reaches 1*a* advance in the direction indicated by arrow A. The conveyor or conveyors define an elongated path wherein the sheets 5 of the stream 4 advance in the direction of arrow A and which includes two mutually inclined portions 1A and 1B. This is due to the fact that the upper reaches 1*a* of the conveyors are trained over a pulley, roll or an analogous deflecting element 2 (which may but need not be driven) defining an orientation changing station 3. The path portions 1A and 1B make an acute angle alpha which, in the embodiment of FIG. 1, is somewhat less than 30 degrees. It has been found that the angle alpha can be reduced to 15 degrees or increased to 90 degrees without departing from the spirit of the invention. The arrangement is such that the path portion 1B slopes downwardly with reference to the path portion 1A, i.e., the sheets 5 in the path portion 1A travel along an upwardly sloping path whereas the path of sheets 5 in the path portion 1B is at least substantially horizontal.

The apparatus further comprises a guide 6 which is disposed above, spaced apart from the orientation changing station 3 and located substantially midway between the lateral marginal portions of sheets 5 which constitute the stream 4. The underside of the guide 6 has a preferably smooth surface 7 which is located in the path of advancement of the leaders 5′ of successive sheets 5 so that the leaders 5′ advance along a path which is defined in part by the guide 6. The latter can include two parallel rails, plates, bars or rods extending in the direction of arrow A and being slightly inclined with reference to the path portion 1B. An advantage of a guide which is assembled of two or more spaced-apart components is that this provides room for impingement of a beam 15 of radiation upon successive leaders 5′ while such leaders advance toward and through the orientation changing station 3, namely, while they are temporarily separated from the trailing ends 5″ of the respective preceding sheets 5. It is equally possible to employ a plate-like guide which has an aperture for the passage of the beam 15. The beam 15 issues from a source 13 which forms part of a photocell 12 or an analogous monitoring device further including a mirror 14 or other suitable reflecting means serving to direct the deflected beam (this deflected beam can be said to constitute an optical signal) to a conventional counter 16 of any known design. The latter counts the signals and transmits, at selected intervals, signals denoting detection of predetermined numbers of sheets 5 in the stream 4. The arrangement is preferably such that the beam 15 which is reflected by the mirror 14 impinges upon a transducer forming part of the photocell 12 and serving to transmit electric signals to the counter 16.

The operation is as follows: The upper reaches 1*a* of the conveyors constituting or forming part of the transporting unit 1 advance successive sheets 5 of the stream 4 first along the path portion 1A and thereupon along the path portion 1B, always in the general direction indicated by the arrow A. The guide 6 and its surface or surfaces 7 cause the leaders 5′ of successive sheets 5 to advance along a second path which is denoted in part by the phantom lines 8, 9 and is defined in part by a portion of the surface 7. Owing to downward inclination of the path portion 1B relative to the path portion 1A, the leaders 5′ of successive sheets 5 arriving at or approaching the orientation changing station 3 become separated from (i.e., they rise above) the trailing ends 5″ of the respective preceding sheets 5 so that the station 3 can be said to effect a partial singularization of neighboring sheets 5. The locus where the leaders 5′ of successive sheets 5 impinge upon the surface or surfaces 7 of the guide 6 is indicated at 11. The surface 7 thereupon imparts to each leader 5′ a component of movement toward the path portion 1B. The surface 7 further ensures that the paths of successive leaders 5′ are identical irrespective of potential differences in the spacing 10 between the leaders 5′ of successive sheets 5 in the stream 4. In other words, each of the leaders 5′ strikes against the surface 7 at one and the same locus 11 regardless of whether or not the spacing (distance 10) between some or all of successive leaders 5′ deviates from the anticipated or optimum spacing. Also, each leader 5′ remains in engagement with the guide 6 during travel through the same distance, namely, from the aforementioned locus 11 to the point where the phantom-line 9 touches the surface 7.

The source 13 of radiation (e.g., a source of visible light) emits the beam 15 in such direction that the beam intersects, in chord-like manner, a portion of the path (7, 8, 9) for the leaders 5′ of successive sheets 5 during travel from the portion 1A toward the portion 1B of the path of the stream 4, namely, while the leaders 5′ are separated from the trailing ends 5″ of the respective preceding sheets 5. The guide 6 is configurated in such a way that it does not interfere with propagation of the beam 15 from the source 13 toward the reflector 14, i.e., such propagation can be interrupted only by the leaders 5′ of successive sheets 5 while the leaders 5′ advance along the path 7, 8, 9. In other words, each leader 5′ interrupts the beam 15 for a certain interval of time, namely, while the leader 5′ covers the distance 15′ by travelling along a path portion which intersects the path of the beam 15. The interruption of the beam 15 by a leader 5′ causes the counter 16 (which normally receives the reflected beam from the reflector means 14 or a signal which is generated by the reflected beam) to record the presence of a sheet 5.

The mutual inclination of path portions 1A and 1B, as well as the orientation of the beam 15 issuing from the source 13, are selected in such a way that the distance 15′ (between the foremost and the rearmost portions of the path 7, 8, 9 where a leader 5′ intercepts the beam 15) is as short as possible because this renders it possible to reduce the distance 10, i.e., to increase the extent of overlap of neighboring sheets 5 in the stream 4 The distance 10 can vary but cannot be less than the distance 15′ because, otherwise, the beam 15 would be interrupted at all times and the counter 16 could not record the number of sheets 5 in the stream 4. The exact design of the counter 16 forms no part of the invention; all that matters is to use a counter which can react to the impingement or absence of impingement of a beam of radiation upon the mirror 14 in order to record the presence of a leader 5' in the path 7, 8, 9 along which the leaders 5' advance during transfer of the respective sheets 5 from the path portion 1A into the path portion 1B. The photocell 12 can be replaced with a monitoring device in the form of a proximity detector switch, a sensor which operates with electromagnetic waves or any other detector which is capable of detecting the leaders 5' travelling along the path 7, 8, 9.

Referring now to the apparatus which is shown in FIGS. 2, 3 and 4, the transporting unit of this apparatus comprises a first conveyor 17 (note FIG. 2) which is an endless belt (or a set of parallel endless belts) trained over several groups of pulleys or rolls one of which is shown at 18. The upper reach of the conveyor 17 transports a stream 4 of partially overlapping sheets 5 along a first portion 1A of an elongated path wherein the sheets advance in the direction indicated by the arrow A. The second portion 1B' of such path is defined by a conveyor in the form of an upright (preferably vertical) duct or magazine 19 wherein the sheets 5 can descend by gravity and are caused to accumulate into stacks or piles S. The orientation changing station is shown at 20; this station is defined by the illustrated group of coaxial pulleys 18 and can be said to cause successive sheets to change the direction of their movement through an angle of close to or exactly 90 degrees.

The duct 19 can be open at its front and rear sides, as viewed in FIG. 2, and its other two sides are defined by pairs or sets of upright rods or bars 22 constituting composite side walls secured to the frame or housing 21 of the apparatus. The duct 19 forms part of a stacking device or apparatus which enables groups of successive sheets 5 to accumulate into stacks S which are thereupon transported to further processing stations, e.g., into baling or other machines, not shown. The stacking device cooperates with the counter 16 (not shown in FIGS. 2 to 4) to ensure that each and every finished stack S contains the same number of superimposed sheets. The duct 19 can be installed at a level above a conventional turntable (not shown) which turns alternate fully grown stacks S through an angle of 180 degrees about a vertical axis so that each inverted stack can be assembled with the next-following (non-inverted) stack S in order to ensure that the upper side of the resulting composite stack will be disposed in a horizontal plane. Such inversion of alternate stacks is desirable and advantageous when the leader 5' of a sheet 5 is thicker than its trailing end 5'' or vice versa. It is assumed that the leaders 5' are thicker than the trailing ends 5'' because each sheet 5 is assumed to constitute a folded-over sheet (or a set of folded-over sheets) with the fold line located at the leading end. When the turntable receives a composite stack consisting of two successively formed stacks S, a pusher or another suitable expelling device transfers the composite stack onto a conveyor or directly into the next processing station, not shown.

The stacking apparatus further comprises a rake-like intercepting member 23 which is movable between the solid-line first position and the phantom-line second position 23' of FIG. 2. In the first position, the prongs or tines **23*a* of the member 23 extend into the interior of the duct 19, preferably to such an extent that they cover at least two-thirds of the respective cross-section of the duct. Penetration of prongs of the member 23 into and their withdrawal from the interior of the duct 19 is unimpeded because at least the right-hand side wall 22 of the duct 19 is apertured so as to permit unobstructed movements of the rake-like member 23 between the first and second positions. The member 23 is mounted on a shaft 24 which is journalled in the frame 21 and can be rocked back and forth at predetermined intervals by a motor 25 here shown as a double-acting fluid-operated cylinder and piston unit, preferably a pneumatically operated unit. The aforediscussed feature that the prongs of the rake-like member 23 extend into the duct 19 to an extent which ensures that the member 23 extends across at least two-thirds of the respective cross-section of the duct is desirable and advantageous because this prevents the left-hand portion(s) of the sheet(s) 5 on the member 23 from bending downwardly, while the sheets rest on the prongs of the member 23, and from thus interfering with the formation of a predictable stack S. Excessive penetration of the prongs on the member 23 into the duct 19 is neither necessary nor always desirable because it takes more time to retract the member 23 to the position 23'** if, in the solid-line position, such member constitutes a temporary horizontal partition across the entire cross-sectional area of the duct.

The stacking apparatus further comprises a composite gate including two additional rake-like intercepting members 26 and 27 which are located at a level below the member 23 and are movable between the illustrated solid-line positions in which they support a stack S and retracted positions (not shown) in which a fully assembled stack S is permitted to descend onto the aforementioned turntable. The additional intercepting members 26 and 27 are mirror symmetrical to one another and are respectively pivotable on or with parallel horizontal shafts 28, 29. The means for rocking the shafts 28, 29 in order to pivot the vertical arms of the members 26, 27 in opposite directions comprises a motor 30 in the form of a double-acting pneumatic or hydraulic cylinder and piston unit whose cylinder is articulately connected to the frame 21 and whose piston rod is articulately connected with a two-armed lever 31 rigidly connected to the upright arm of the additional intercepting member 27. The left-hand arm of the lever 31, as viewed in FIG. 2, is articulately connected with a lever **31*a* by a device 32 which permits the levers 31 and 31*a* to slide relative to one another while pivoting about the axes of the respective shafts 29 and 28. The lever 31 is rigid with the upwardly extending arm of the additional intercepting member 26. The prongs of the members 26 and 27 support the lowermost sheet 5 of the stack S while the stack S grows. The upper rake-like intercepting member 23 enters the duct 19 when the gate including the additional intercepting members 26, 27 has completed the accumulation of a stack S containing a predetermined number of superimposed sheets 5, and the member 23 continues to extend into the duct 19 and intercepts the oncoming sheets 5 during the interval which is required to move the members 26, 27 apart so that the fully grown stack S can descend onto the turntable therebelow and to return the members 26, 27 to the illustrated operative positions. The intercepting member 23 is retracted to the position 23' (i.e., completely outside of the duct 19) as soon as the members 26, 27 reassume their illustrated positions whereby the sheet or sheets 5 which were intercepted by the member 23 are free to descend by gravity and to form the lowermost sheet or sheets of the growing stack S on the members 26 and 27. As mentioned above, alternate fully grown stacks S are preferably inverted by the turntable to ensure the accumulation of stacks whose top surfaces are horizontal even if one edge of each sheet 5** is thicker than the other edges.

The monitoring device which cooperates with the counter to effect the generation of signals denoting predetermined numbers of counted sheets 5 is adjacent to and is located at a level above the orientation changing station 20. The latter is located below a composite guide including two parallel rails 33 (see also FIG. 3) which are spaced apart from one another and extend in the direction of the arrow A. The rails 33 are rigidly connected to each other by crossheads 34 and 35, and the entire guide means including the rails 33 and the crossheads 34, 35 is mounted on the frame 21 by a bolt 36 or a like fastener which is attached to a transverse 37 forming part of the frame 21. The rails 33 present a composite guide surface 38 which faces the orientation changing station 20 and imparts to the oncoming sheets 5 a component of movement in a direction toward the open top of the duct 19, i.e., a substantially vertical component of movement The monitoring device includes a photocell which is laterally adjacent to one of the guide rails 33 (see FIG. 3) and includes a light source 39 with a photoresistor or another suitable transducer as well as a light reflecting mirror 40. The beam of light is shown at 41; this beam issues from the source 39 to impinge upon a leader 5' or upon the mirror 40; in the latter instance, the beam 41 is reflected into the source 39 wherein the transducer generates an appropriate electric signal for transmission to the counter.

The operation is as follows:

The conveyor 17 delivers successive sheets 5 of the stream 4 to the orientation changing station 30 where the leaders 5' of successive sheets 5 become separated from the trailing ends 5'' of the respective preceding sheets. The thus separated leaders 5' strike against the surfaces 38 of the rails 33 and travel along a path including portions of the surfaces 38 and a portion denoted by the phantom line 43. In order to ensure that the sheets 5 will not buckle on impingement of their leaders 5' upon the surfaces 38 of the rails 33, the apparatus of FIGS. 2 to 4 further comprises a deforming device 42 in the form of an endless belt or band whose lower reach engages the median portions of sheets 5 on the conveyor 17 and flexes the sheets so that the upper side of each sheet 5 advancing toward the orientation changing station 20 exhibits a concave shape (see FIG. 4) To this end, the group of pulleys 18 at the station 20 includes several coaxial components having different diameters with the smaller-diameter component or components located at the center of the path for the sheets 5. Therefore, the lower reach of the belt 42 can depress the median portions of successive sheets 5 and thus enhances their resistance to bending on impact against the surfaces 38 of the rails 33. The path which the parts 42 and 33 define for the leaders 5' during travel toward, past and beyond the orientation changing station 20 is intersected by the light beam 41 in chord-like manner, as at 5. The distance 45 is less than the distance 44 between the leaders 5' of successive sheets 5 which form the stream 4. The reason is the same as described in connection with FIG. 1; i.e., otherwise, the light beam 41 would remain interrupted at all times. Each interruption of the light beam 41 (by an oncoming leader 5') entails the generation of a signal which is transmitted to the counter to regulate the operation of the motors 25 and 30 in the aforedescribed manner.

As mentioned above, the angle between the orientation of a sheet 5 in the path portion 1A and the orientation of a sheet in the path portion 1B' is or approximates 90 degrees. This angle, as well as the orientation of the surfaces 38, are to be selected in such a way that the length of the chord 45 is invariably less than the distance 44. The latter distance may vary within reasonable limits, but it should not be reduced to less than the distance 45 because this would result in the generation of misleading signals, i.e., the number of signals transmitted to the counter would not match the number of sheets 5 advancing through and beyond the orientation changing station 20.

As mentioned above, the belt 42 deforms and thereby stiffens the sheets 5 whose leaders 5' approach the surfaces 38 of the rails 33 so that such leaders are not bent about axes extending transversely of the longitudinal direction of the stream 4 but invariably strike against the surfaces 38 to be properly guided along the path 42, 38, 43 on their way onto the upper intercepting member 23 or onto the topmost sheet 5 of the stack S growing on the gate including the additional intercepting members 26, 27. In other words, by the simple expedient of providing the belt 42 which imparts to the upper sides of successive sheets 5 to a concave shape, the apparatus of the present invention ensures that each and every leader 5' will travel along one and the same path so that it can interrupt the light beam 41 for the required interval of time. The change in orientation of successive sheets 5 begins when their leaders 5' reach and begin to slide along the surfaces 38. Actually, the sheets 5 are stiffened even more during travel of their leaders 5' along the surfaces 38 because the flexing of successive sheets about an axis extending centrally and lengthwise of the path 1A, 1B' becomes even more pronounced at such time. This is due to the fact that the rails 33 are located substantially midway between the marginal portions of the stream 4. Such increased stiffness of successive sheets 5 during travel through the station 20 further enhances the likelihood of accurate and reliable counting of each and every sheet in the stream, even if the speed of the stream 4 is a multiple of the speed of scalloped streams in a conventional apparatus. It has been found that the improved apparatus can properly count and stack sheets forming a stream which is transported at a speed required to advance up to 70,000 sheets per hour.

The width of the guide means (6 or 33) is preferably a fraction of the width of the path for the stream 4, preferably less than half the width of the stream. This, combined with the feature that the guide means is disposed centrally or nearly centrally of the path, ensures that the front ends of marginal portions of successive sheets 5 can flex upwardly during travel along the guide means 6 or 33. As explained above, this contributes to rigidity of sheets during travel past the monitoring means and hence to more reliable detection of each and every sheet in the stream.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for manipulating sheets in a stream of successive partially overlapping sheets, comprising a sheet receiving duct; means for transporting successive sheets of the stream in a predetermined direction to a position above said duct; a plurality of sheet intercepting and stacking means disposed at different levels of said duct; means for moving said intercepting and stacking means into and for withdrawing such intercepting and stacking means from said duct at the respective levels so as to effect a cascading of sheets from each upper level to the respective lower level; means for receiving stacks of sheets from said duct upon withdrawal of the intercepting and stacking means form the lowermost one of said levels; guide means for deflecting downwardly and into said duct successive sheets which are supplied by said transporting means to said position above said duct, said transporting means defining a first path extending to said guide means and said guide means defining for the sheets a second path which is inclined with reference to said first path; and means for counting the thus deflected successive sheets, comprising an optoelectronic counter including a radiation source arranged to direct a beam of radiation across the course of advancement of the leaders of successive sheets along said second path.

2. The apparatus of claim 1, wherein said transporting means comprises a conveyor defining said first path and having two marginal portions extending in substantial parallelism with said direction and a central portion disposed below said marginal portions, and further comprising deforming means for imparting to the sheets in said first path a substantially concavo-convex shape including means for urging the median portions of sheets in said first path toward the central portion of said conveyor.

3. The apparatus of claim 1, wherein said guide means has a downwardly sloping surface along which the leaders of successive sheets slide during movement along said second path, said transporting means including a conveyor having two marginal portions extending in said direction and a central portion, said sloping surface being in line with the central portion of said conveyor.

4. The apparatus of claim 1, wherein the width of said second path at most equals half the width of said first path.

* * * * *